US006957754B2

(12) United States Patent
Bolan et al.

(10) Patent No.: US 6,957,754 B2
(45) **Date of Patent: *Oct. 25, 2005**

(54) SHIRT SLEEVE PRESSING MACHINE WITH PLEAT PRESSING HEADS

(76) Inventors: Thomas V. Bolan, 8 Sherwood Forest Dr., Andover, NJ (US) 07821; Peerin R. Vaning, R.R.#2, Box 203C-BD, Dushore, PA (US) 18614; Paul A. Karpich, R.R.#1, Box 197, Springville, PA (US) 18844; Linda A. Riebeling, 4 Dendron Dr., Tunkhannock, PA (US) 18657

( * ) Notice: Subject to any disclaimer, the term of this patent is extended or adjusted under 35 U.S.C. 154(b) by 0 days.

This patent is subject to a terminal disclaimer.

(21) Appl. No.: 10/368,585

(22) Filed: Feb. 20, 2003

(65) Prior Publication Data

US 2004/0164106 A1 Aug. 26, 2004

(51) Int. Cl.[7] ..... D06C 15/00

(52) U.S. Cl. ..... 223/73; 38/12

(58) Field of Search ..... 223/73, 72, 57; 38/12

(56) References Cited

U.S. PATENT DOCUMENTS

| | | | | | |
|---|---|---|---|---|---|
| 2,278,959 | A | * | 4/1942 | Williams | 223/57 |
| 5,474,216 | A | | 12/1995 | Harrod et al. | |
| 5,675,918 | A | | 10/1997 | Harrod et al. | |
| 6,389,716 | B1 | * | 5/2002 | Riebeling et al. | 38/12 |
| 6,497,060 | B1 | | 12/2002 | Bolan, Jr. et al. | |

* cited by examiner

*Primary Examiner*—John J. Calvert
*Assistant Examiner*—James G Smith

(57) ABSTRACT

Apparatus and method for pressing the sleeves of a shirt and the pleated areas of the sleeves adjacent the cuffs during the same pressing operation.

9 Claims, 5 Drawing Sheets

SHIRT SLEEVE PRESSING MACHINE WITH PLEAT PRESSING HEADS

BACKGROUND OF THE INVENTION

This invention relates generally to apparatus and method for pressing the sleeves of a long sleeve shirt and more particularly, to apparatus and method capable of pressing the sleeves, the pleats and the adjacent areas of the sleeves just above the cuffs during the same pressing operation.

The sleeve of a standard long sleeved shirt is manufactured with a pleat just above the cuff on the outside edge of the shirt while wearing it. This pleat is present due to the fact that the sleeve diameter is larger than the cuff diameter causing the gathering of the material, hence the pleat.

Machines for pressing the sleeves of a shirt are commercially available such as the cabinet style bag sleever Model CSL which has been manufactured and sold by the assignee of this invention, Hoffman-New Yorker, Inc. and which is generally illustrated in U.S. Pat. No. 6,389,716 B1 which is commonly owned by Hoffman-New Yorker, Inc. As illustrated in that patent, those machines generally include a pair of laterally spaced, vertically extending, sleeve bucks with inflatable air bags attached to the front and rear faces of the bucks. At the upper end of each of the bucks is a pneumatically operated T-clamp for holding the cuffs of the shirt in place during a sleeve pressing operation. To press the sleeves, at an accessible loading station, with the back of the shirt facing an operator, the operator passes the shoulders of the shirt over the cuff clamps and the shirt is fully extended downwardly with the sleeves over the bucks. The cuffs of the shirt are positioned under the open T-clamps and the clamps are then closed to lock the cuffs in place with the pleats of the shirt resting against the rear face of the bucks. Low pressure air is then supplied to the air bags to expand the sleeve cavity and remove wrinkles from the sleeves, and the shirt is then tensioned to define the pleats. The bucks are then moved from the loading station to a pressing station within a pressing cabinet and movable steam heated pressing heads are then applied against the sleeves and the bucks for a predetermined period of time under the control of a timer. Upon completion of the timed cycle, the bucks are returned from the pressing cabinet to the loading station and upon movement out of the cabinet the clamps are automatically opened thereby releasing the cuffs. The sleeves and the shirt are then removed upwardly from the bucks. This is generally the manner in which the apparatus illustrated in U.S. Pat. No. 6,389,716 is operated.

When the shirt is removed from the press, the pleat is then pressed by a secondary operation separate from the machine and is normally performed on an ironing board with a hand iron.

It certainly is desirable to be able to press the pleats on the sleeve of the shirt during the same sleeve pressing operation, and thereby eliminate the separate manual pleat pressing operation. This would provide a more efficient, reliable and economical machine and would save substantial time and labor associated with the overall pressing operation.

While the CSL machine illustrated in U.S. Pat. No. 6,497,060 has enjoyed substantial commercial success, applicants have recognized the need to improve the construction and operation of that machine and the invention as described below was developed to satisfy that need.

SUMMARY OF THE INVENTION

The primary object of this invention is to provide a novel machine for pressing the sleeves of a long sleeved shirt and the pleated areas of the sleeves just above the cuff during the same pressing operation.

Another object of the invention is to provide the above novel pressing machine which includes separate pleat pressing heads mounted within the pressing cabinet and actuatable to press the pleats as the sleeves are being pressed at the pressing station.

A further object of the invention is to provide the above novel machine wherein the main sleeve pressing heads and pressing bucks are somewhat modified from those used in prior standard machines such as the CSL machine to accommodate separate pleat pressing heads which press the pleats of the sleeves during the same pressing operation.

Still another object of the invention is to provide the above novel machine wherein the pleat pressing heads are operated independently of the main pressing heads of the machine.

It is apparent that applicants' novel machine as described above and its method of operation, eliminate the need to press the pleats by way of a secondary operation such as by using a hand iron and traditional ironing board. In addition, if a shirt does not have pleats, the pleat pressing heads need not be activated and the machine can be used in a conventional manner.

Other objects and advantages of the invention will become apparent from reading the following detailed description of the invention wherein reference is made to the accompanying drawings.

DETAILED DESCRIPTION OF THE INVENTION

Figure 2:
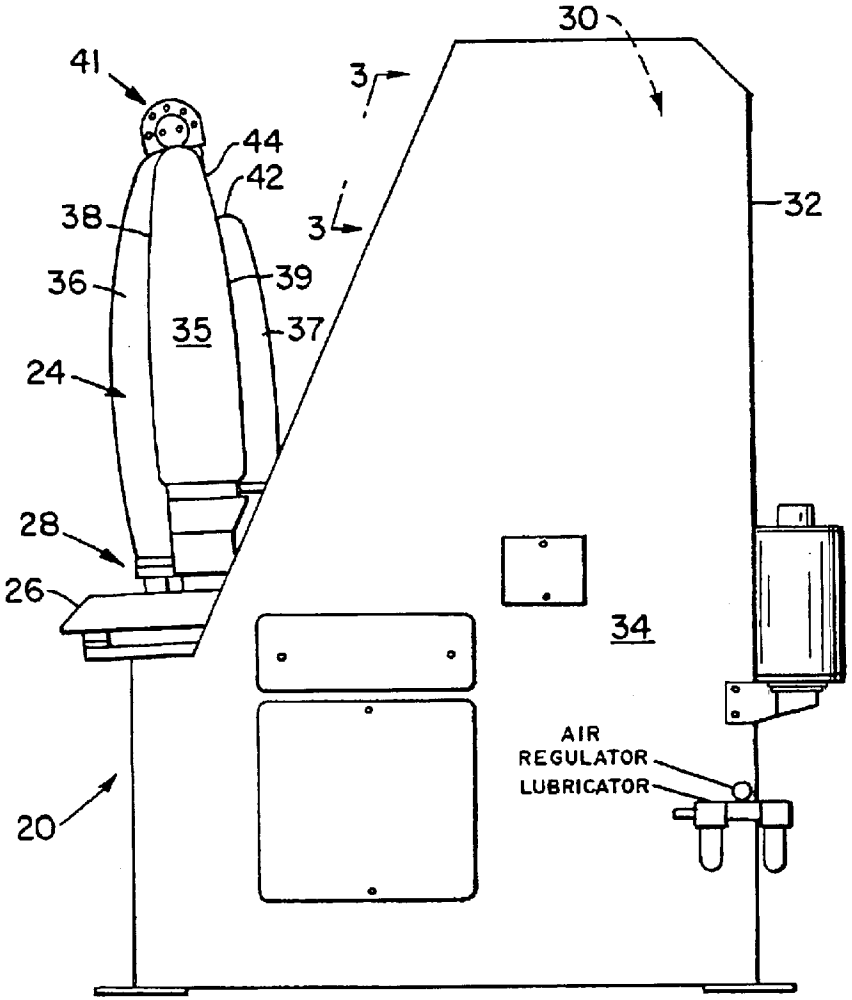
FIG. 2 is a side elevational view of the machine taken along line 2—2 of FIG. 1 illustrating the main bucks position in an outer accessible sleeve loading station.
Figure 1:
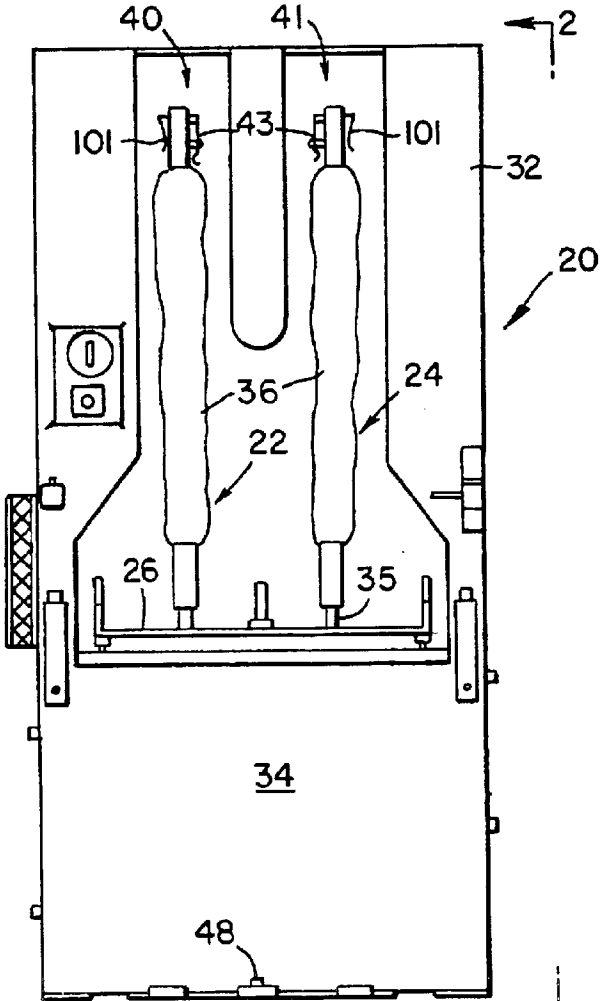
FIG. 1 is a front elevational view of the shirt sleeve pressing machine of the invention.
Figure 3:
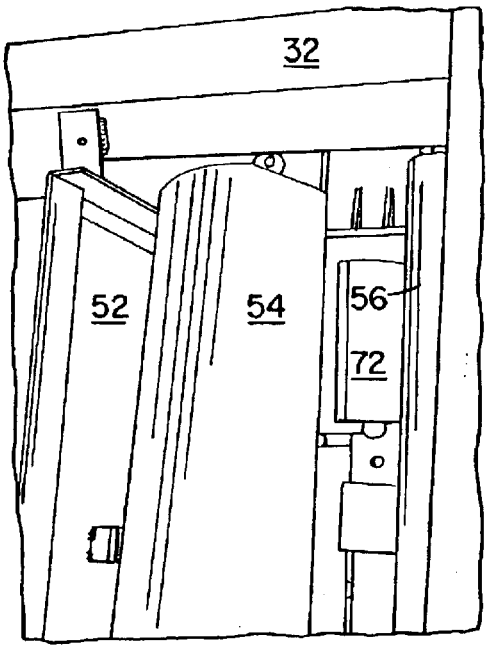
FIG. 3 is a fragmentary front elevational view taken along line 3—3 of FIG. 2 illustrating the pleat pressing head as it is positioned within the pressing cabinet.
Figure 4:
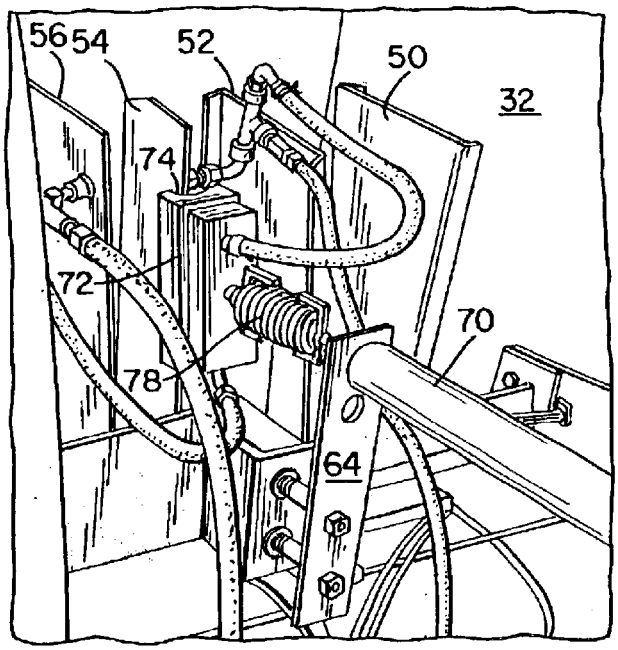
FIG. 4 is a fragmentary rear, left side perspective view taken within the pressing cabinet and illustrating one of the pleat pressing heads mounted within the cabinet, with the head being illustrated in a rearward deactivated position.

Referring now to FIGS. 1 and 2, the shirt sleeve pressing machine of the invention includes a pair of laterally spaced sleeve pressing buck assemblies 22 and 24 mounted at their lower ends on a pan 26 which is moveable between a forward operator accessible loading station 28 and a rearward pressing station 30 within the upper portion 32 of cabinet 34. Each buck assembly 22 and 24 includes an upright padded buck plate 35 connected at its lower end to pan 26 and front and rear air inflatable bags 36 and 37 attached respectively to the front and rear faces 38 and 39 of buck 35. Pneumatically operated cuff clamp assemblies 40 and 41 are fixed to the upper end of each buck plate 35.

The construction of machine 20 described thusfar is essentially the same as that illustrated in U.S. Pat. No. 6,389,716 except that the upper end 42 of inflatable bag 37 terminates a distance below clamps 40 and 41 to expose the upper portion 44 of rear face 39 of buck plates 35 for a purpose to be described hereinbelow.

Generally speaking, to press the sleeves of a shirt the buck assemblies 22 and 24 are first located at the accessible loading station 28 and, with the back of the shirt facing the operator, the shoulders of the shirt are passed over the cuff clamp assemblies 40 and 41 and the collar of the shirt is pressed downwardly so that the left sleeve of the shirt fully extends downwardly on buck assembly 22 and the right sleeve of the shirt fully extends downwardly on buck assembly 24, with the seams of the sleeves in position over the front air bags 36. The operator then places the cuff under tension clip 101 and the cuff seams on either side of the cuff button plackets behind the pneumatic cuff clamps 43 facing the center of the machine, the cuff clamps then being activated thereby pinning the cuff seams in place. The operator then uses foot pedal 48 to activate a blower which expands the air bags 36 and 37 of each buck assembly 22 and 24. Using the cuff seam clamps and expansion bags 36 and 37 to apply tension, the operator smoothes the sleeves by working the material downward while aligning the sleeve seams on the front bags 36. The tension provided by the operator pulling the sleeves away from the cuff clamps and against the air bags smoothes the shirt sleeves and helps fold and set the cuff seams.

The operator then tensions and smoothes the pleat area of the sleeves above the cuff against the exposed padded portion 44 of rear faces 39 of padded buck plates 35 while further tensioning and reinforcing the pleat folds using the cuff tensioning clips 101 and textured areas provided on the outside surface of air bags 36 and 37. When the sleeves of the shirt are properly dressed on buck assemblies 22 and 24, pan 26 and buck assemblies 22 and 24 are moved rearwardly from station 28 to the pressing station 30 within upper cabinet section 32 wherein buck assembly 22 is positioned in standard fashion between steam heated side pressing heads 50 and 52 and buck assembly 24 is positioned between steam heated pressing heads 54 and 56 in conventional fashion. Heads 50 and 52 and heads 54 and 56 are closable in known fashion upon the sides of the buck plates 35 of buck assemblies 22 and 24 to press the sleeves.

In accordance with this invention, separate pneumatically operated pleat pressing head assemblies 60 and 62 are mounted within cabinet 32 via brackets 64 and 66, respectively, which are fixed to a frame member 68 which is part of the cabinet 34. Assembly 60 is mounted within cabinet portion 32 in adjacent operating relationship with buck assembly 22 and main pressing heads 50 and 52. Similarly, assembly 62 is mounted within cabinet portion 32 in adjacent operating relationship with buck assembly 24 and main pressing heads 54 and 56. Only assembly 62 is shown in FIGS. 3–7.

Figure 9:
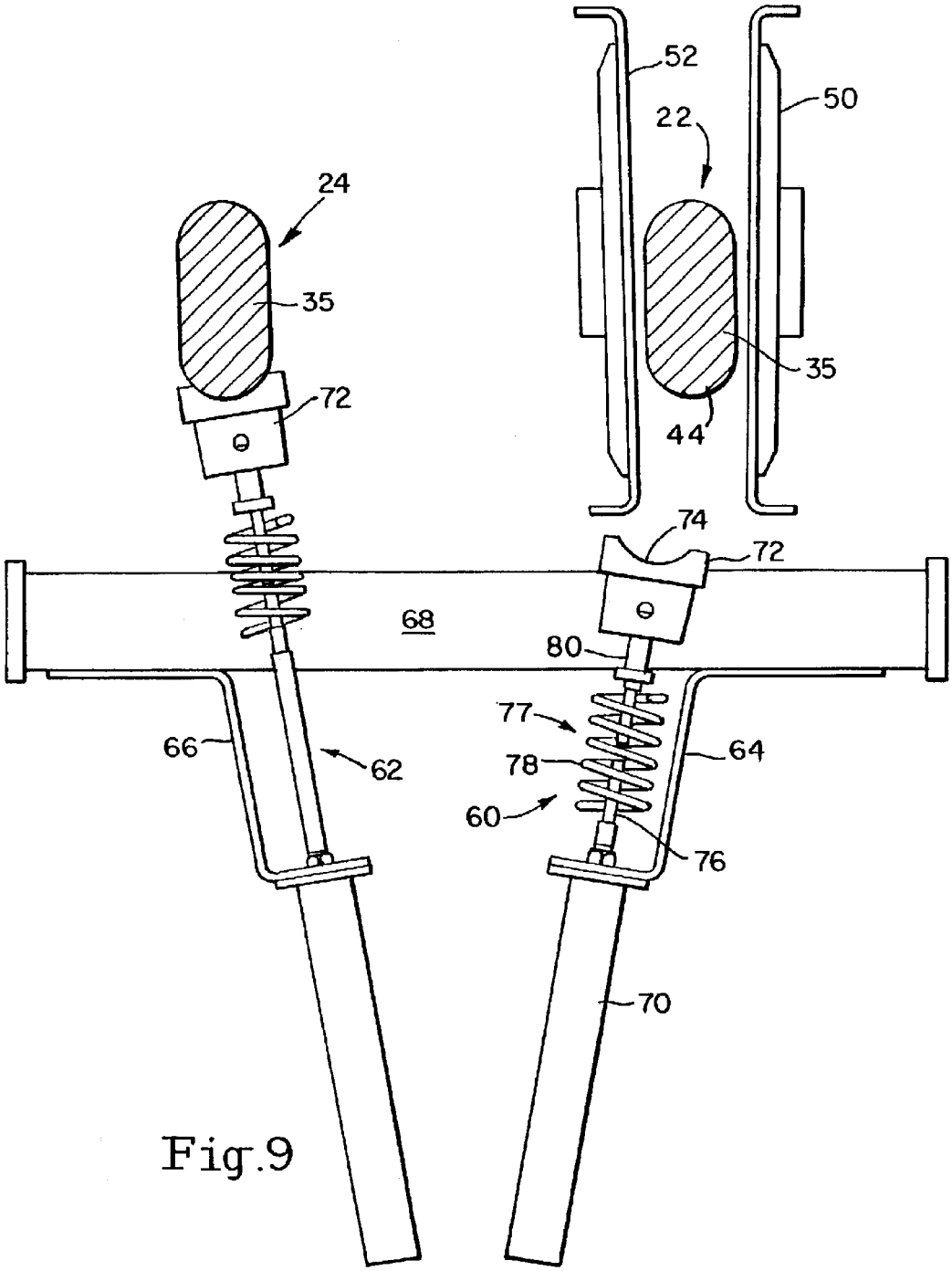
FIG. 9 is a schematic plan view of the sleeve pressing bucks and heads and the pleat pressing heads as they are mounted within the pressing cabinet.

Each pleat pressing head assembly 60 and 62 includes a pneumatic cylinder 70 fastened to bracket 64, a pleat pressing head 72 which has a contoured pressing surface 74 adapted to mate with a contoured rear face 44 of bucks 35. Head 72 is connected to the piston rod 76 of cylinder 70 by a self aligning coupling 77 which includes a coil spring 78 the inner end of which is fixed to piston rod 76 and the outer end of which is fixed to a separate shaft or stem 80 which is fixed to head 72. As shown in FIG. 9, head assemblies 60 and 62 are mounted to extend angularly outwardly from the center of upper cabinet portion 32 toward buck assemblies 22 and 24, respectively. Each inner pressing head 52 and 54 has a recess or cut-out 90 at its rear corner to provide clearance for pleat head 72 and a line 92 feeding steam to the head as the pleat head moves into engagement with a buck 35 (see FIGS. 6 and 7).

Figure 5:
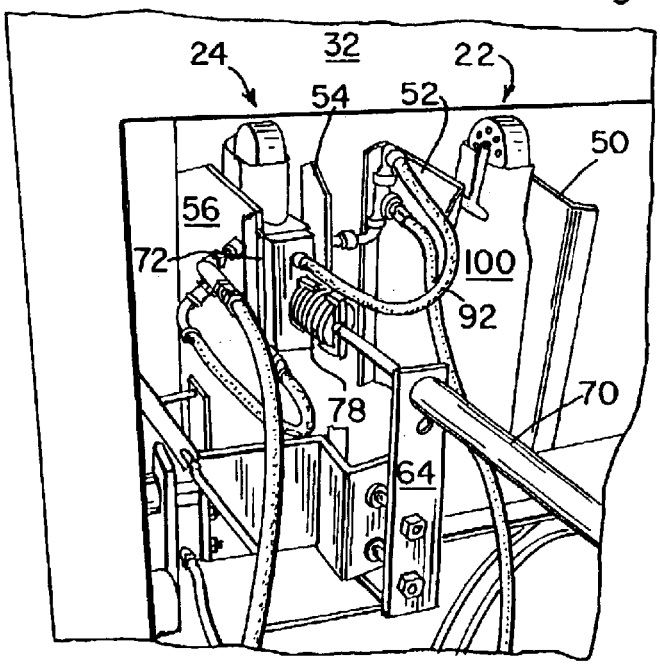
FIG. 5 is a fragmentary view similar to FIG. 4 but illustrating the pleat pressing head in an activated forward pleat pressing position.
Figure 6:
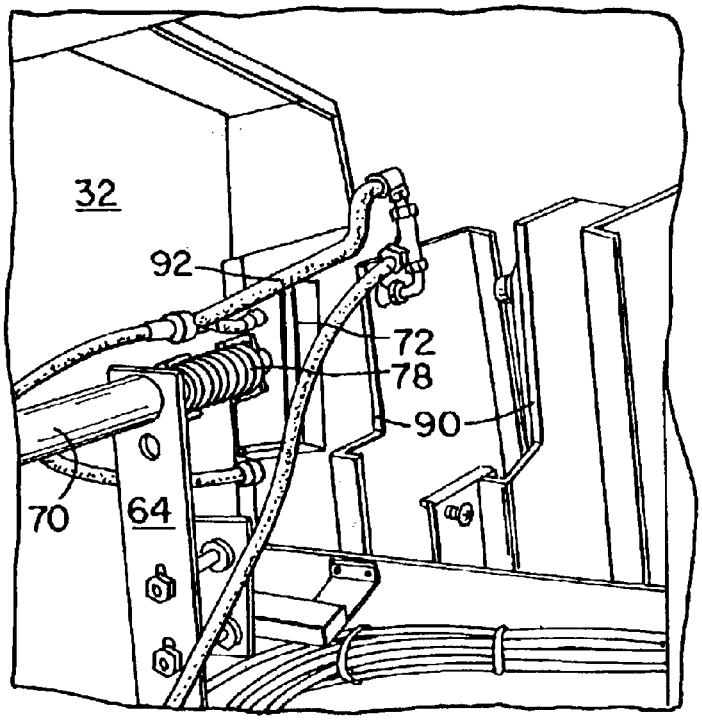
FIG. 6 is a fragmentary view similar to FIG. 4 but taken from the right side of the pleat pressing head.
Figure 7:
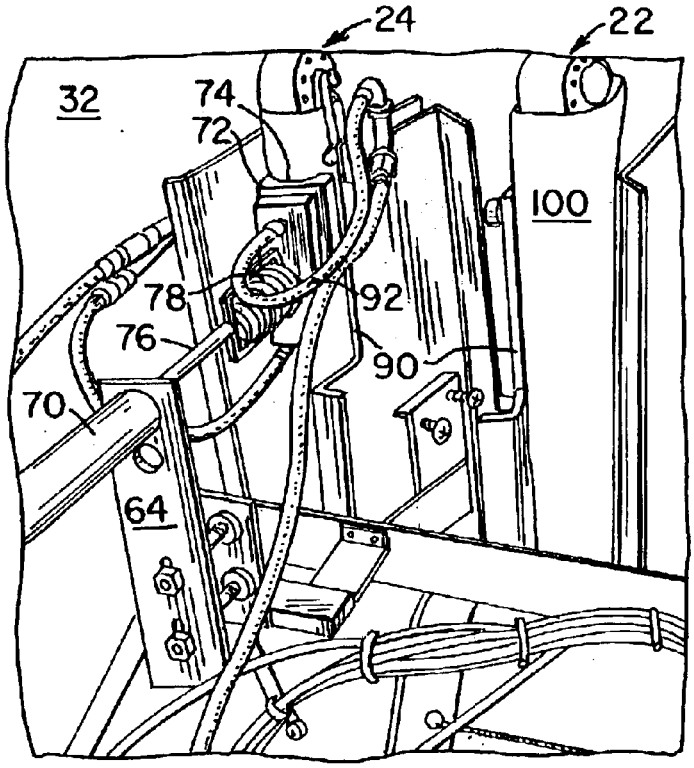
FIG. 7 is a view similar to FIG. 5 but taken from the right side of the pleat pressing head.
Figure 8:
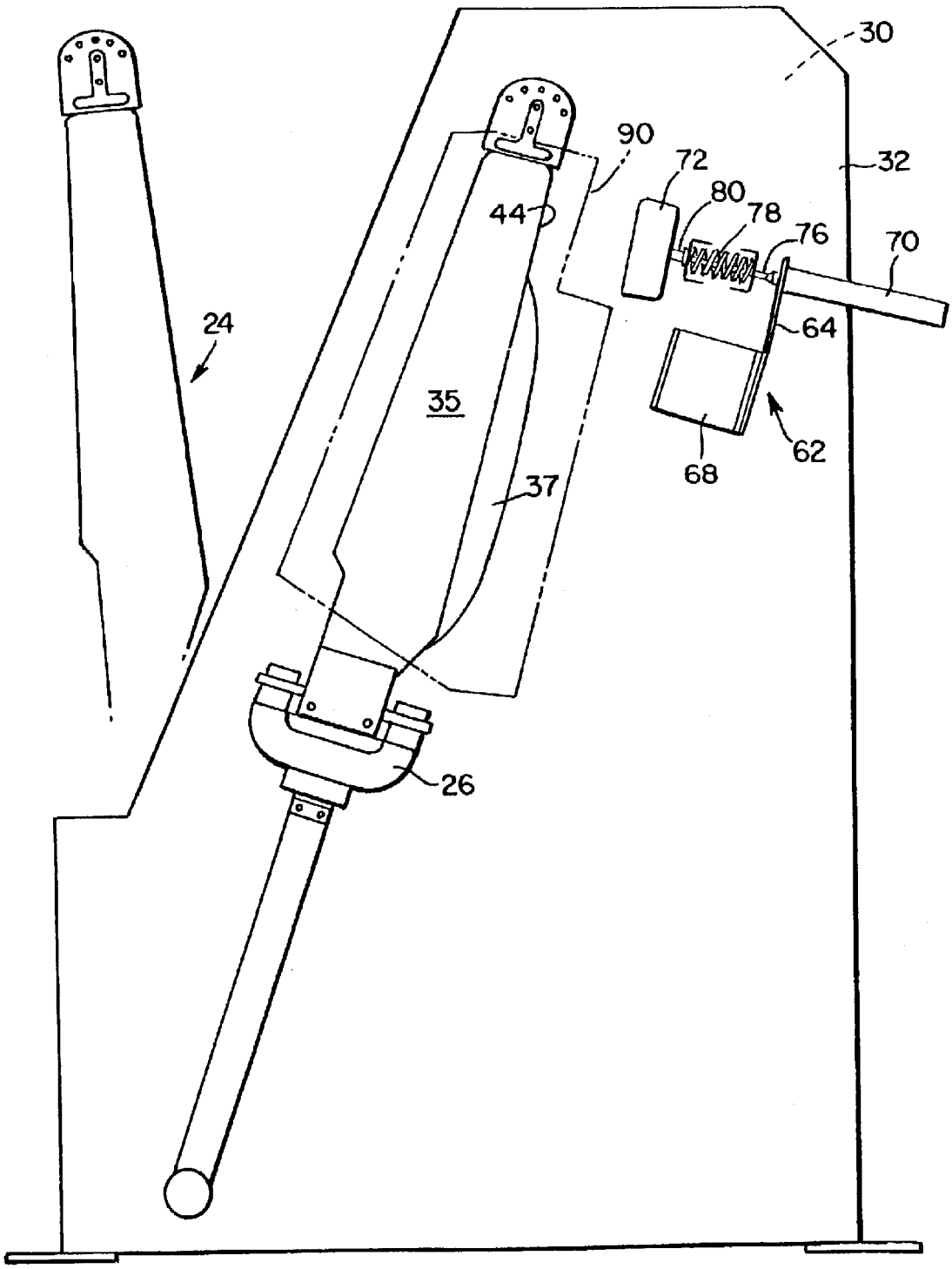
FIG. 8 is a fragmentary schematic illustration of a sleeve pressing buck initially positioned in a forward operator accessible station and then positioned at the pressing station within the pressing cabinet adjacent the pleat pressing head which is actuatable to press the pleats of the sleeves as the sleeves themselves are being pressed.

When buck assemblies 22 and 24 are positioned between main heads 50 and 52 and 54 and 56 respectively, as shown in FIGS. 5, 7, 8 and 9, the pleat pressing heads 72 operatively oppose the exposed portion 44 of rear face 39 and are adapted to press the pleats of the sleeve which are resting against portion 44. To complete the sleeve pressing operation, air cylinder 70 is actuated to extend pressing heads 72 forwardly into engagement with the pleats 100 resting on portions 44 thereby pressing the pleats (FIGS. 5 and 7). After the auxiliary heads 72 have completed the pleat press they are retracted and main steam heated heads 50, 52, 54 and 56 will then be closed to engage against the sleeves and press them against the sides of the bucks. At the end of the pressing cycle, main heads 50, 52, 54, and 56 along with cuff clamps 40 and 41 will be released and air bags 36 and 37 are deflated. A pair of release timers control the length of the finishing cycle, and when the set time expires the main heads and the auxiliary heads will open and the bucks will return to the loading position 28 in readiness for the next shirt pressing operation.

As already mentioned, the front surface 74 of auxiliary heads 72 is contoured to mate with the upper contoured surface 44 of buck plates 35 to ensure that the pleated area of the sleeves is properly pressed. Also as mentioned, the flexible self aligning coupling 77, which is universally adjustable, also ensures that the contoured surface 74 of heads 72 properly mates with surface 44 to enhance the finishing step for the pleats on the shirt.

It is readily apparent that the invention as described readily accomplishes the objects set forth initially hereinabove. By using the machine of the invention an operator may press the sleeves of the shirt and also the pleated portions of the sleeve located just above the cuffs. This provides for a much more efficient, cost effective, and time saving operation and eliminates the need for separately pressing the pleats of a shirt after the sleeves of the shirt have been pressed as was the common practice with prior conventional machines.

The invention may be embodied in other specific forms without departing from the spirit or essential characteristics thereof The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. Apparatus for pressing the sleeves of a shirt and the pleats on the sleeves adjacent the shirt cuffs comprising a pair of laterally spaced upright bucks over which the sleeves may be placed, cuff clamp means mounted at the upper end of each of the bucks, said bucks being movable between a shirt loading station and a shirt pressing station, main pressing heads located at said pressing station for pressing the sleeves mounted on said bucks, and auxiliary pressing heads located at said pressing station for pressing the pleats, whereby the sleeves and pleats of a shirt are finished in the same pressing operation.

2. The apparatus of claim 1, each of said bucks having opposite sides and front and rear faces, each of said bucks being positioned between two of said main pressing heads at said loading station which are movable toward and away from said opposite sides, to press a sleeve against the side of said buck, each of said auxiliary pressing heads operatively opposing said rear face of a buck to press the pleats on said rear face.

3. The apparatus of claim 2, each of said bucks having air inflatable bags connected to said front and rear faces, the upper end of the bag on the rear face terminating a distance below the cuff clamp to provide a pressing area for an auxiliary pressing head to press the pleats.

4. The apparatus of claim 3, comprising means adjustably mounting each auxiliary pressing head to permit said head to self align with said pleat pressing area.

5. The apparatus of claim 4, wherein each auxiliary pressing head has a contoured pressing surface corresponding to the contour of the pressing area on the rear face of said buck.

6. The apparatus of claim 2, wherein at least two of said main pressing heads are recessed at their rear to provide clearance for said auxiliary pressing heads as they are moved toward said pressing areas to press said pleats.

7. Apparatus for pressing a sleeve of a shirt and the pleats on the sleeve adjacent the shirt cuff comprising an upright buck over which the sleeve may be placed, cuff clamp means mounted at the upper end of the buck, said buck being movable between a shirt loading station and a shirt pressing station, main pressing heads located at said pressing station for pressing the sleeve mounted on said buck, and an auxiliary pressing head located at said pressing station for pressing the pleats, whereby the sleeve and pleats of a shirt are finished in the same pressing operation.

8. A method of pressing the sleeves of a shirt and the pleated portions of the sleeves adjacent the shift cuffs comprising:

providing a pressing machine including a pair of laterally spaced upright bucks having cuff clamps mounted at the upper end thereof, the bucks being movable from a loading station to a pressing station where each buck is positioned between a pair of main pressing heads, the machine also including auxiliary pressing heads at said pressing station positioned to operatively oppose the rear faces of said bucks;

position the bucks at the loading station;

with the back of the shirt facing outwardly, pass the shoulders of the shirt over the cuff clamps and pull the sleeves downwardly on the bucks;

place the cuffs of the shirt in the clamps, and close the clamps;

dress the sleeves and pleats on the bucks;

move the bucks from the loading station to the pressing station;

move the auxiliary pressing heads toward the bucks to press the pleats;

move the main pressing heads toward the bucks to press the sleeves;

return the bucks to the loading station; and remove the finished sleeves from the bucks.

9. A method of pressing a sleeve of a shirt and the pleated portion of the sleeve adjacent the shirt cuff comprising:

providing a pressing machine including an upright buck having a cuff clamp mounted at the upper end thereof, the buck being movable from a loading station to a pressing station where it is positioned between a pair of main pressing heads, the machine also including an auxiliary pressing head at said pressing station positioned to operatively oppose the rear faces of said buck;

position the buck at the loading station;

with the back of the shirt facing outwardly, pass a shoulder of the shirt over the cuff clamp and pull the sleeve downwardly on the bucks;

place the cuff of the shirt in the clamp and close the clamp;

dress the sleeve and pleat on the buck;

move the buck from the loading station to the pressing station;

move the auxiliary pressing head toward the buck to press the pleats;

move the main pressing heads toward the buck to press the sleeve;

return the buck to the loading station; and remove the finished sleeve from the buck.

* * * * *